US007872627B2

(12) United States Patent
Fushimi

(10) Patent No.: US 7,872,627 B2
(45) Date of Patent: Jan. 18, 2011

(54) DISPLAY UNIT

(75) Inventor: Kaito Fushimi, Kanagawa (JP)

(73) Assignee: NEC Electronics Corporation, Kawasaki, Kanagawa (JP)

( * ) Notice: Subject to any disclaimer, the term of this patent is extended or adjusted under 35 U.S.C. 154(b) by 1346 days.

(21) Appl. No.: 11/281,626

(22) Filed: Nov. 18, 2005

(65) Prior Publication Data

US 2006/0114211 A1 Jun. 1, 2006

(30) Foreign Application Priority Data

Nov. 29, 2004 (JP) ..... 2004-344719
Aug. 31, 2005 (JP) ..... 2005-250419

(51) Int. Cl.
*G09G 3/36* (2006.01)

(52) U.S. Cl. ..... 345/98; 345/99; 345/100

(58) Field of Classification Search ..... 345/1.1, 345/3.1, 9, 98–100, 115, 204, 211–214, 519, 345/545, 691, 5; 713/156; 715/723; 463/43; 348/558, 231.6
See application file for complete search history.

(56) References Cited

U.S. PATENT DOCUMENTS 4,367,488 A * 1/1983 Leventer et al. ..... 348/467
5,877,780 A * 3/1999 Lu et al. ..... 345/519
5,986,636 A * 11/1999 Wu ..... 345/691
6,411,302 B1 * 6/2002 Chiraz ..... 345/545
6,522,309 B1 * 2/2003 Weber ..... 345/1.1
6,697,033 B1 * 2/2004 Leung et al. ..... 345/5
6,700,559 B1 * 3/2004 Tanaka et al. ..... 345/88
6,816,191 B1 * 11/2004 Shyu ..... 348/231.6
6,873,307 B2 * 3/2005 Nitta et al. ..... 345/3.1
6,914,637 B1 * 7/2005 Wolf et al. ..... 348/473
7,034,786 B2 * 4/2006 Ham ..... 345/88
7,079,128 B2 * 7/2006 Kim ..... 345/213
7,079,129 B2 * 7/2006 Shigeta ..... 345/213
7,091,946 B2 * 8/2006 Tsutsui et al. ..... 345/100
7,243,291 B1 * 7/2007 Williams ..... 714/776
7,325,199 B1 * 1/2008 Reid ..... 715/723
7,372,457 B2 * 5/2008 Wang ..... 345/204
7,445,551 B1 * 11/2008 Okada et al. ..... 463/43
7,532,174 B2 * 5/2009 Luk ..... 345/3.1
2001/0004257 A1 * 6/2001 Nitta et al. ..... 345/211

(Continued)

FOREIGN PATENT DOCUMENTS

JP 2003-241730 8/2003

(Continued)

*Primary Examiner*—Prabodh M Dharia
(74) *Attorney, Agent, or Firm*—McGinn IP Law Group, PLLC

(57) ABSTRACT

A driving circuit of the display unit includes a driving circuit including a read only memory and a rewritable nonvolatile memory. The rewritable nonvolatile memory stores display quality specifying information for specifying the display quality of a display panel connected to the driving circuit. The read only memory stores the display quality initial information used for initialization of the display quality of an optional display panel. By preferentially using the information stored in the rewritable nonvolatile memory, it is possible to drive the display panel at an optimum display quality in the normal state. Moreover, even when it is impossible to normally read data from the rewritable nonvolatile memory, it is possible to drive the display panel at an initial-state display quality by using the data in the read only memory.

25 Claims, 10 Drawing Sheets

U.S. PATENT DOCUMENTS

2002/0089518 A1* 7/2002 Shigeta ..... 345/629
2003/0070132 A1* 4/2003 Pasqualino et al. ..... 714/758
2004/0217953 A1* 11/2004 Someya et al. ..... 345/204
2004/0255113 A1* 12/2004 Ogura ..... 713/156
2005/0212965 A1* 9/2005 Stone et al. ..... 348/558
2006/0235732 A1* 10/2006 Miller et al. ..... 705/7
2008/0222734 A1* 9/2008 Redlich et al. ..... 726/26
2009/0276771 A1* 11/2009 Nickolov et al. ..... 717/177

FOREIGN PATENT DOCUMENTS

JP 2004-21067 1/2004

* cited by examiner

| 86 Z_EPROM | 85 Z_ROM | 84 COMP | 83 EPA BIT | 82 P_ERR | 81 SELECTED BLOCK |
|---|---|---|---|---|---|
| 0 | 0 | 0 | 1 | 1 | ROM |
| | | | | 0 | EPROM |
| | | | 0 | | ROM |
| | | 1 | | | EPROM |
| | 1 | | | | ROM |
| 1 | | | | | EPROM |

FIG. 10

FIRST AREA AND SECOND AREA HOLD THE SAME CONTENT BY DUPLICATING IT AS BACKUP BY ASSUMING A TROUBLE OF NONVOLATILE MEMORY

1003

1001

1002

| | WORD | BIT8 | BIT7 | BIT6 | BIT5 | BIT4 | BIT3 | BIT2 | BIT1 | BIT0 |
|---|---|---|---|---|---|---|---|---|---|---|
| FIRST AREA | Wd0 | HPTY | VCOMH7 | VCOMH6 | VCOMH5 | VCOMH4 | VCOMH3 | VCOMH2 | VCOMH1 | VCOMH0 |
| | Wd1 | HPTY | VCOML7 | VCOML6 | VCOML5 | VCOML4 | VCOML3 | VCOML2 | VCOML1 | VCOML0 |
| | Wd2 | HPTY | T7 | T6 | T5 | T4 | T3 | T2 | T1 | T0 |
| | Wd3 | HPTY | GM27 | GM26 | GM25 | GM24 | GM23 | GM22 | GM21 | GM20 |
| | Wd4 | HPTY | GM17 | GM16 | GM15 | GM14 | GM13 | GM12 | GM11 | GM10 |
| | Wd5 | HPTY | VPTY7 | VPTY6 | VPTY5 | VPTY4 | VPTY3 | VPTY2 | VPTY1 | VPTY0 |
| SECOND AREA | Wd6 | HPTY | VCOMH7 | VCOMH6 | VCOMH5 | VCOMH4 | VCOMH3 | VCOMH2 | VCOMH1 | VCOMH0 |
| | Wd7 | HPTY | VCOML7 | VCOML6 | VCOML5 | VCOML4 | VCOML3 | VCOML2 | VCOML1 | VCOML0 |
| | Wd8 | HPTY | T7 | T6 | T5 | T4 | T3 | T2 | T1 | T0 |
| | Wd9 | HPTY | GM27 | GM26 | GM25 | GM24 | GM23 | GM22 | GM21 | GM20 |
| | Wd10 | HPTY | GM17 | GM16 | GM15 | GM14 | GM13 | GM12 | GM11 | GM10 |
| | Wd11 | HPTY | VPTY7 | VPTY6 | VPTY5 | VPTY4 | VPTY3 | VPTY2 | VPTY1 | VPTY0 |

VERTICAL PARITY BIT OF FIRST AREA

VERTICAL PARITY BIT OF SECOND AREA

HORIZONTAL PARITY BIT IN EACH BYTE

| FIRST AREA (1201) | | SECOND AREA (1202) | | CRITERIA | |
|---|---|---|---|---|---|
| DATA CHECK | PARITY CHECK | DATA CHECK | PARITY CHECK | | |
| GOOD | GOOD | GOOD | GOOD | GOOD | 1203 |
| BAD | *1 | *1 | *1 | BAD | 1204 |
| *1 | BAD | *1 | *1 | BAD | 1204 |
| *1 | *1 | BAD | *1 | BAD | 1204 |
| *1 | *1 | *1 | BAD | BAD | 1204 |

*1: DON'T CARE

DATA: DATA CHECK OF FIRST AREA AND SECOND AREA (NOT INCLUDING PARITY BIT)

PARITY: PARITY CHECK OF EACH OF FIRST AREA AND SECOND AREA (VERITCAL AND HORIZONTAL)

DISPLAY UNIT

BACKGROUND OF THE INVENTION

1. Field of the Invention

The present invention relates to a display unit, particularly to a driving circuit of a flat panel display unit.

2. Description of Related Art

A portable information terminal unit represented by a cellphone (hereafter referred to as cellphone) is generalized. A display unit for displaying the information obtained through communication is set to a presently generalized portable terminal. A display unit to be mounted on a portable terminal generally uses a display unit using an LCD (Liquid Crystal Display) (hereafter referred to as liquid-crystal display). The liquid-crystal display includes an LCD panel for displaying characters and images and an LCD driving circuit and the LCD panel is driven by the LCD driving circuit.

The LCD panel has a display contrast characteristic specific for the LCD panel. In general, an LCD panel manufactured by a panel maker is shipped to a set maker and built in a liquid-crystal display. To keep all liquid-crystal displays manufactured by the set maker at an optimum display quality, it is necessary to fine-adjust the display contrast for each LCD panel when they are shipped to the set maker (for example, VCOM adjustment and LCD driving-voltage setting-value adjustment) and decide an optimum control register value. A conventional LCD driving circuit includes an EEPROM for storing the control register value (for example, refer to Patent Document 1). The conventional display unit keeps a control register value decided when the display unit is shipped from a plant by writing the value in an EEPROM. Therefore, a display unit after shipped drives an LCD panel at a proper display quality when an EEPROM driving circuit reads a register value.

FIG. 1 is a block diagram showing a configuration of a conventional liquid-crystal display. As shown in FIG. 1, the conventional liquid-crystal display is constituted by including an LCD driving circuit 101, LCD panel 102, and CPU 103. The LCD driving circuit 101 includes an LCD control driver and an EEPROM. The LCD driving circuit 101 is connected to the LCD panel 102 and CPU 103 and generates a control signal for driving the LCD panel 102 by responding to a display instruction output from the CPU 103. The LCD panel 102 has a specific display contrast characteristic for each panel.

An LCD control driver 104 set to the LCD driving circuit 101 is a control circuit for performing LCD display operation control (function for displaying a character or image) by responding to a display instruction sent from the CPU 103. Moreover, the LCD control driver performs the display quality control (adjustment of facing-electrode signal VCOM and adjustment of LCD driving-voltage set value) of the LCD panel 102 in accordance with a set value read from an EEPROM. The EEPROM is an information memory for storing the information (register value) on the display quality of the LCD panel 102. In the case of a conventional liquid-crystal display, a register value output from an EEPROM is supplied to an LCD control driver and thereby, the display quality of the LCD panel 102 is kept in a proper state.

As shown in FIG. 1, the conventional liquid-crystal display does not include an area for storing the backup data of the register value. Therefore, when the EEPROM malfunctions or data in the EEPROM is lost, an abnormal display state may appear. In this case, a technique is known which prevents unexpected data from being erroneously set by setting the register value to a default value (for example, refer to Patent Document 2). In the case of the technique disclosed in Patent Document 2, each register value is set to a default value at the time of an EEPROM error and default setting is kept until a register is reset from a CPU. When the default setting is setting which cannot be displayed such as stop of a clock signal, display disappears until the register is reset from the CPU. Moreover, address and data common to every liquid-crystal display which are not necessary in rewriting are stored in the EEPROM in addition to address and data of a register which are necessary in optimum adjustment for every liquid-crystal display. Particularly, when the register address value stored in the EEPROM is broken and error determination cannot be made, a case may occur in which unrelated setting is applied to different addresses and display cannot be made. Moreover, because there is a data area which is unnecessary in storing in the EEPROM, an EEPROM section becomes large and it is difficult to decrease a circuit in size and price.

By using an area for storing the backup data of display quality of a display unit, it is possible to automatically change display quality to backup data even at the time of an EEPROM error and keep a display state without through the CPU. Moreover, a technique capable of decreasing a liquid-crystal display in size is desired.

[Patent Document 1] Japanese Patent Laid-Open No. 2004-21067

[Patent Document 2] Japanese Patent Laid-Open No. 2003-241730

SUMMARY OF THE INVENTION

A problem to be solved by the present invention is to provide a technique for decreasing the load of a CPU and downsizing a display unit by holding the backup data of the information on the specific display contrast characteristic of the display unit including a display panel having the specific contrast characteristic for each display panel and thereby, automatically changing display quality to the backup data even at the time of an EEPROM error, and keeping a display state without through the CPU.

Means for solving the problem is described below by using numbers used for "DETAILED DESCRIPTION OF THE PREFERRED EMBODIMENTS". These numbers are added to clarify the correspondence relation between the description of "What is claimed is" and the "DETAILED DESCRIPTION OF THE PREFERRED EMBODIMENTS". However, these numbers must not be used for interpretation of the technical range of the present invention described in "What is claimed is".

To solve the above problem, a driving circuit (4) of a display unit is constituted as described below. The driving circuit is constituted by including a rewritable nonvolatile memory as a first memory (5) and a read only memory as a second memory (6). Display quality specifying information for specifying the display quality of a display panel to be connected to the driving circuit is stored in the rewritable nonvolatile memory (5). Moreover, display quality initial information used for initialization of the display quality of an optional display panel (2), that is, general-purpose setting information is stored in the read only memory (6). Furthermore, the rewritable nonvolatile memory (5) stores setting values which must be individually set correspondingly to the display panel (2) as the display quality specifying information and the driving circuit drives the display panel by preferentially using the information stored in the rewritable nonvolatile memory (5).

It is possible to drive the display panel at an optimum display quality in the normal state by storing the information specific for each display panel (2) in the rewritable nonvolatile memory (5) and storing the initial value of the memory (5) (set value on a display contrast universally used by an optional panel) in the read only memory (6), and preferentially using the information stored in the rewritable nonvolatile memory (5). Moreover, even if data cannot normally read from the rewritable nonvolatile memory (5), it is possible to drive the display panel (2) at an initial-state display quality by using the data in the read only memory (6).

According to the present invention, because a display unit including a display panel having a specific display contrast characteristic for each panel holds the backup data of the information on the display contrast characteristic, it can keep display by checking the display contrast characteristic information without using an external command in the display unit and automatically changing an internal set value to the backup data without through a CPU even if an error occurs. In this case, it is unnecessary to perform resetting from the CPU to the display unit and it is possible to reduce the load of the CPU. Moreover, by using the backup data for the display contrast characteristic information, it is possible to initialize a register without using an external command.

BRIEF DESCRIPTION OF THE DRAWINGS

This above-mentioned and other objects, features and advantages of this invention will become more apparent by reference to the following detailed description of the invention taken in conjunction with the accompanying drawings, wherein:

FIG. 10 is a data mapping table showing a configuration of the cell area of the EEPROM 5;

DETAILED DESCRIPTION OF THE PREFERRED EMBODIMENTS

An embodiment of the present invention is described below. For the following embodiment, a case is described as an example, in which a display unit to be driven by a circuit of the present invention is a liquid-crystal display. This does not mean that a display unit of the present invention is restricted to a liquid-crystal display.

Configuration of Embodiment

Figure 1:
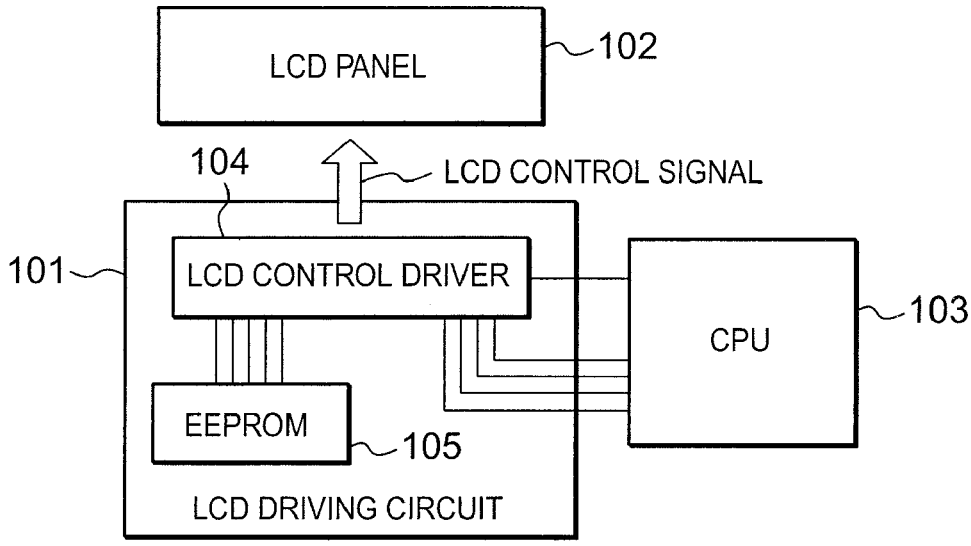
FIG. 1 (RELATED ART)
FIG. 1 is a block diagram showing a configuration of a conventional liquid-crystal display.
Figure 2:
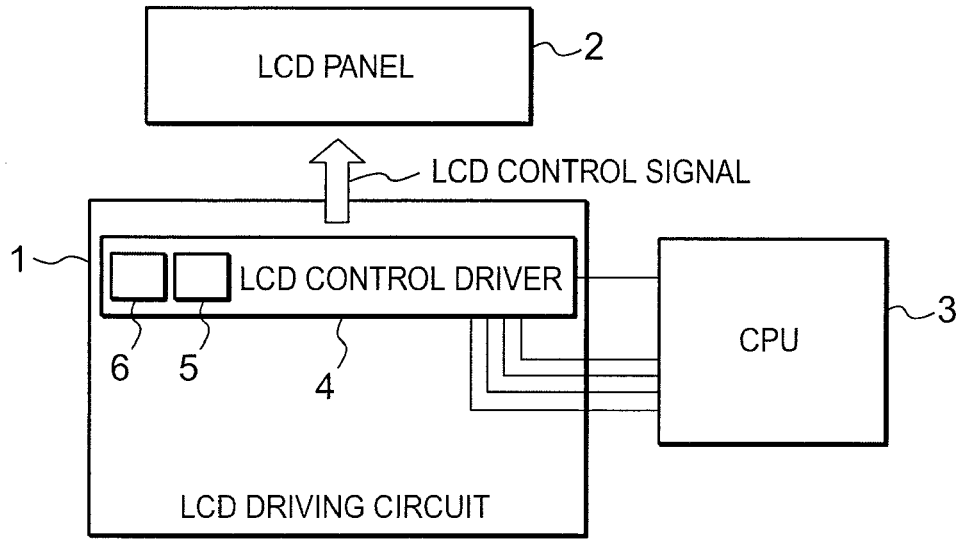
FIG. 2 is a block diagram showing a configuration of a display unit of the present invention.

FIG. 2 is a block diagram showing a configuration of the display unit of this embodiment. As shown in FIG. 2, the liquid-crystal display of this embodiment is constituted by including an LCD (Liquid Crystal Display) driving circuit 1, an LCD panel 2, and a CPU 3. The LCD driving circuit 1 further includes an LCD control driver 4 and the LCD control driver includes an EEPROM 5 and a ROM 6.

The LCD driving circuit 1 is a driving circuit for driving the LCD panel 2. As shown in FIG. 2, the LCD driving circuit 1 is connected to the LCD panel 2 and CPU 3. The LCD panel 2 is an image display functional block set to the liquid-crystal display. The LCD panel 2 displays a display image by responding to an LCD control signal output from the LCD driving circuit 1. The CPU 3 is a processing functional block for controlling the whole of the liquid-crystal display. The CPU 3 interprets an instruction input from the outside and output the result to a predetermined apparatus. The CPU 3 shown in FIG. 2 supplies a display operation control (function for displaying a character and image) signal to the LCD driving circuit 1 by responding to a display instruction or the like input from an input unit (not illustrated).

In FIG. 2, the LCD driving circuit 1 includes the LCD control driver 4. The LCD control driver 4 is a control signal generation functional block for generating a control signal for controlling the LCD panel 2 (hereafter referred to as LCD control signal). As shown in FIG. 2, the LCD control driver 4 is constituted by including an EEPROM (Electronically Erasable PROM) 5 and ROM 6. The LCD control driver 4 specifies the display quality such as shading or luminance (display quality which must be fine-adjusted for each individual piece in accordance with individual LCD panel 2) of the above-described LCD panel 2 in accordance with register values (display quality data) stored in the EEPROM 5 and ROM 6.

As described above, the LCD panel 2 is an information display apparatus for displaying a display image by responding to an LCD control signal. A plurality of LCD panels 2 manufactured by a panel maker have manufacturing fluctuation of a threshold voltage when performing a display operation. Moreover, a module including the LCD panel 2 (hereafter referred to as LCD module) is constituted by including a plurality of components such as ICs and these components also have manufacturing fluctuation. Therefore, when constituting an LCD module, it is necessary to adjust each LCD module so that display quality becomes an optimum state and make the LCD module hold the set value. The LCD driving circuit 1 set to an LCD module whose display quality is already adjusted adjusts an image signal by responding to the set value of the signal when an and is displayed image on the LCD panel 2 and supplies the signal to the LCD panel. Thereby, it is possible to display a high-quality image.

The LCD driving circuit 1 of the present invention includes the EEPROM 5 in the LCD control driver 4. Thereby, an EEPROM conventionally set to the outside of the LCD control driver 4 is omitted. However, because the EEPROM 5 included in the LCD control driver 4 has the same function as a conventional EEPROM, optimum display quality is kept. Moreover, the information stored in the ROM 6 is used for an initial set value whose rewriting is unnecessary. When storing the same information content, it is possible to prevent the chip area of the LCD control driver 4 from increasing by using the ROM 6 because the chip area of the ROM 6 is smaller than the chip area of the EEPROM. The size of the EEPROM 5 is 9 bits×128 words and that of the ROM 6 is 19 bits×128 words.

Figure 3:
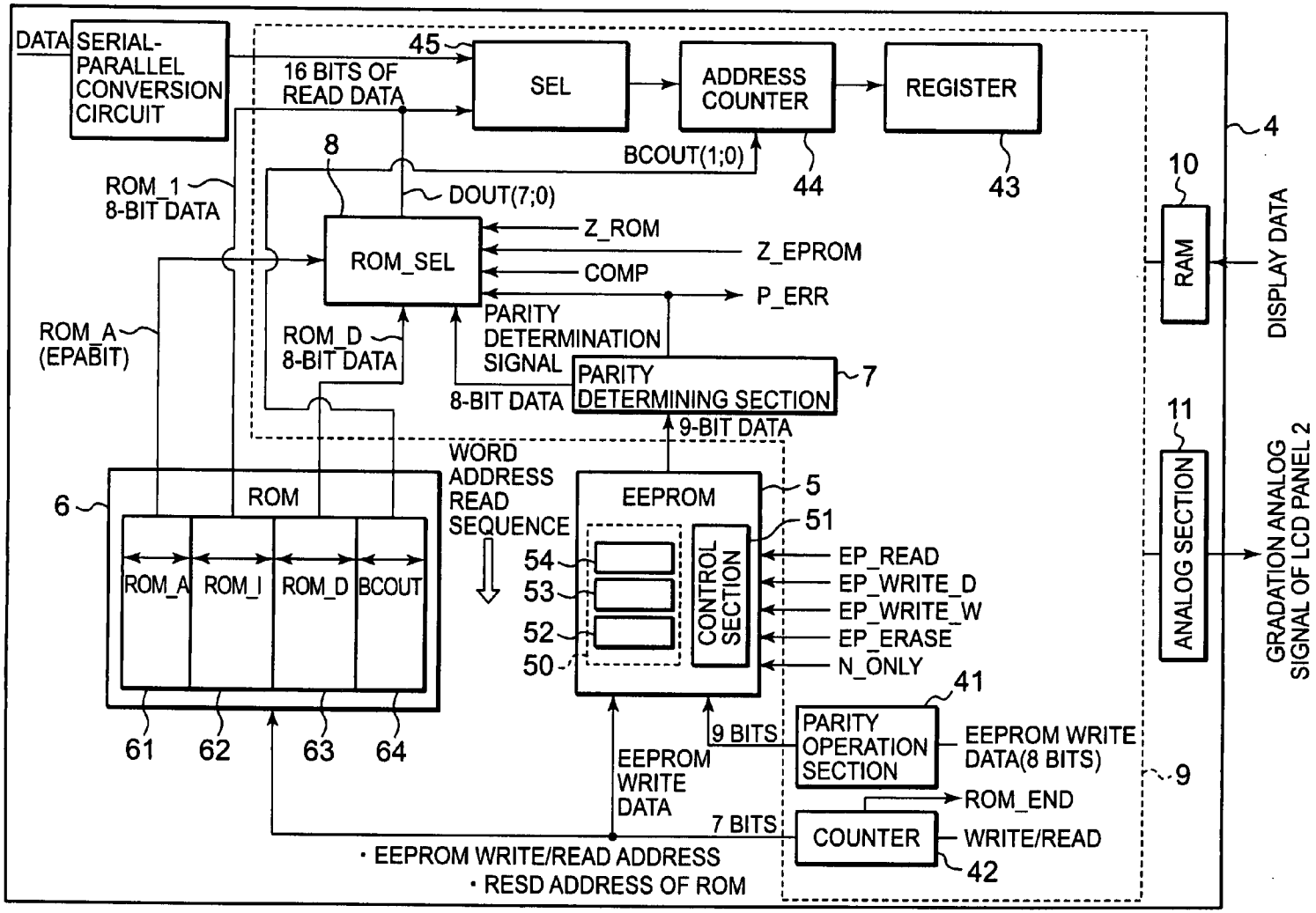
FIG. 3 is a block diagram showing a detailed configuration of the LCD control driver 4.

FIG. 3 is a block diagram showing a detailed configuration of the LCD control driver 4. As shown in FIG. 3, the LCD control driver 4 is constituted by including the EEPROM 5, the ROM 6, a processing section (LOGIC) 9, a RAM 10, and an analog section 11. Moreover, the serial/parallel conversion circuit shown in FIG. 3 is used to set data to a register from the CPU. The EEPROM 5 is a nonvolatile rewritable memory set to the LCD control driver 4. The EEPROM 5 stores the information to be preferably specifically set for each LCD panel 2 among the information used for the display quality of the LCD panel 2. In the case of the present invention, as shown in FIG. 3, it is assumed that an EEPROM is used as a nonvolatile rewritable memory. But this does not mean that a nonvolatile rewritable memory of the present invention is restricted to an EEPROM.

As shown in FIG. 3, the EEPROM 5 is constituted by including a data storing section 50 and data control section 51. The data storing section 50 is a data storing area. The data control section 51 is a data control functional block for controlling read/write of the data stored in the data storing section 50. The data control section 51 includes an access word address latch of the EEPROM 5 and a cell access selecting circuit. The EEPROM 5 controls read/write of data from/in a cell area 53 of the data storing section 50 by the access word address latch and cell access selecting circuit. Moreover, the data storing section 50 has a write data buffer 52, cell area 53, and output circuit 54. Detailed configuration of the EEPROM 5 will be described later.

The ROM 6 is a read only memory which allows only read of the information stored in the ROM 6. The ROM 6 stores the initial information (hereafter referred to as display quality initial information) used to adjust the display quality of the LCD panel 2. The LCD control driver 4 can drive the LCD panel 2 by using the initial information of the driver 4. When the LCD control driver 4 determines that the information on the display quality of the LCD panel 2 stored in the EEPROM 5 (e.g. VCOM adjustment value or LCD driving-voltage set value) cannot properly drive an LCD panel due to a data error, it reads the display quality initial information of the LCD panel 2 stored in the ROM 6 and drives the LCD panel 2.

The ROM 6 has a ROM area and a date control section for reading ROM data. It is assumed that 19-bit data is stored in the ROM 6 as one word. As shown in FIG. 3, a ROM area is constituted by including a first area 61 (ROM_A), second area 62 (ROM_1), third area 63 (ROM_D), and fourth area 64 (BCOUT). The first area 61 (ROM_A) is a storing area for storing a determination flag bit (EPAR bit). The determination flag bit is 1-bit data which is used to determine whether the word address of the ROM 6 is an address present in the EEPROM 5. The second area 62 (ROM_1) is a storing area for storing an index register value. The third area 63 (ROM_D) is a storing area for storing a data register value. The fourth area 64 (BCOUT) is a storing area for storing 2 bits of a byte counter when 1 register address has a plurality of byte data values. Detailed configuration of the ROM 6 will be described later.

The processing section 9 executes the data processing for specifying the display quality of the LCD panel 2 by responding to the data read from the EEPROM 5 and ROM 6. Moreover, the processing section 9 also executes the data processing for writing data in the EEPROM 5. The RAM 10 is an information memory. The RAM 10 stores the display data to be displayed on the LCD panel 2. The analog section 11 is an information processing functional block for processing a supplied analog signal.

In FIG. 3, the processing section 9 is constituted by including a parity determining section 7, a comparator (ROM_SEL) 8 serving as an output section, a parity processing section 41, a counter 42, an internal LOGIC register 43, an address counter 44, and an SEL 45. The parity determining section 7 is an error detection functional block for performing the parity determination of input data. The parity determining section 7 is connected to the EEPROM 5 to determine whether an error occurs in the data read from the EEPROM 5. The comparator (ROM_SEL) 8 is a data output functional block for alternatively outputting data from a plurality of data values. The comparator (ROM_SEL) 8 compares the data read from the EEPROM 5 with the data read from the ROM 6 and outputs proper data in accordance with the comparison result.

The parity computing section 41 is a computing block for performing the parity operation of the data to be written in the EEPROM 5. The counter 42 is a counter control block for controlling a word address counter when writing data in the EEPROM M5. The counter 42 is a word counter for the ROM 6 and EEPROM 5. It is preferable that the counter 42 has a configuration in which it is known that data is written in which word address of the EEPROM 5 and ROM 6 (or data is read from which word address). The internal LOGIC register 43 is a storing area for storing display quality data. The internal LOGIC register 43 stores a resist value output from the comparator (ROM_SEL) 8. Moreover, the computing section 9 decides the display quality of the display panel 2 in accordance with a register value stored in the internal LOGIC register 43 and drives the display panel 2.

Figure 4:
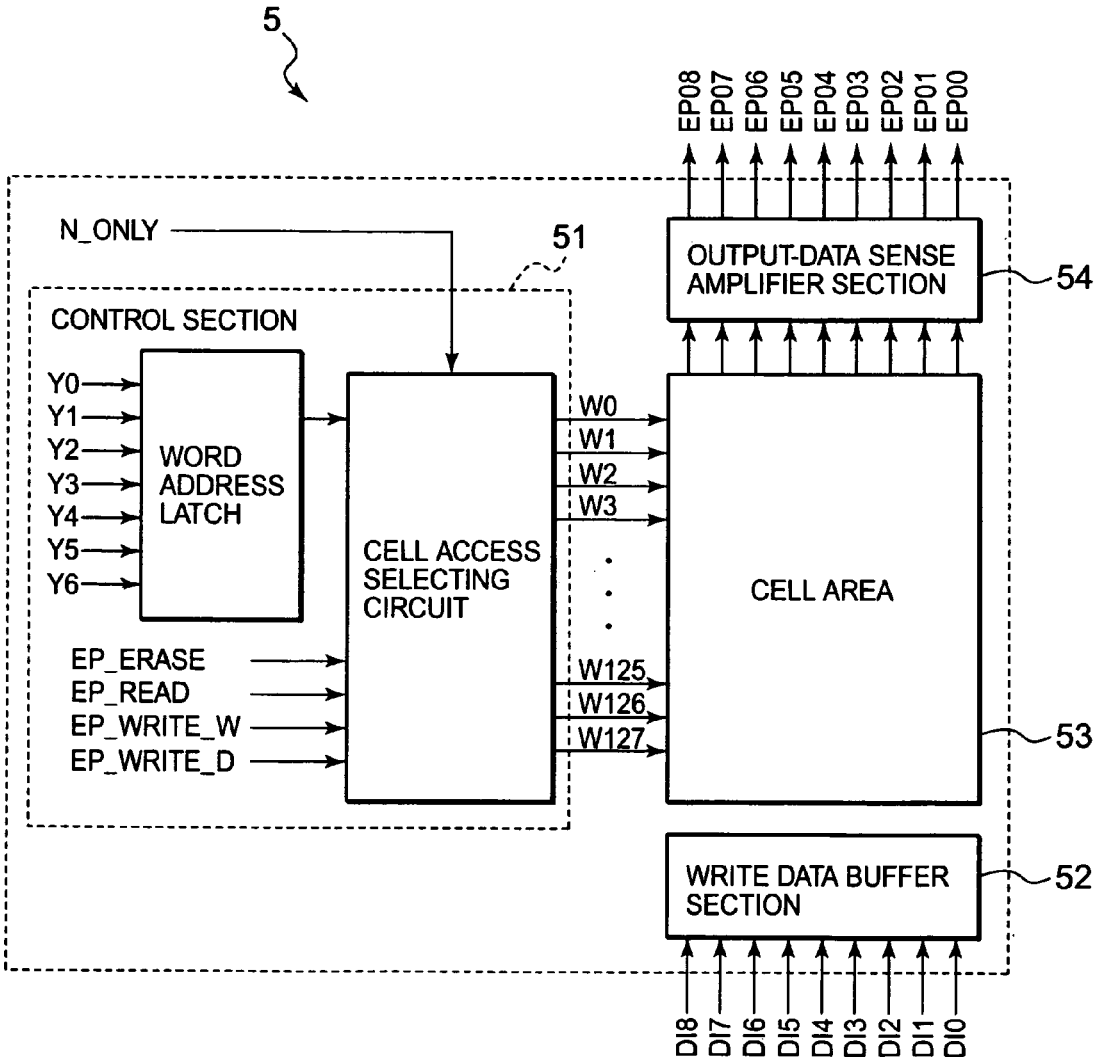
FIG. 4 is a block diagram showing a configuration of an EEPROM 5.

FIG. 4 is a block diagram showing a configuration of the EEPROM 5. As shown in FIG. 4, the EEPROM 5 is constituted by including a control section 51 having a word address latch and cell access selecting circuit, a write data buffer 52, cell area 53, and output data sense amplifier section 54. In FIG. 4, signals Y0 to Y6 are supplied to the word address latch of the control section 51. An output of the access word address latch and signals EP_ERASE (erase), EP_READ (read), EP_WRITE_W (write enable), and EP_WRITE_D (write clock) are supplied to the cell access selecting circuit and the cell access selecting circuit controls access to the cell area 53 in accordance with a signal of the circuit. The write data buffer 52 buffers 9-bit signals of the write data values (DI8 to DI0) supplied from the outside of the EEPROM. Actual write or read data is stored in the cell area 53. The output data sense amplifier section 54 reads read data by a sense amplifier.

In the case of mapping of the data in the cell area 53, it is possible to have two or more same contents by duplicating on another word in all or some of data values. FIG. 10 is a table showing data mapping of the cell area 53. FIG. 10 shows an example of data mapping when having two 6-word data values by duplicating them.

In FIG. 10, the cell area 53 is constituted by including an area defined as a first area 1001 and an area defined as a second area 1002. Moreover, the cell area 53 is constituted by including a word space 1003 including first word Wd0 to twelfth word Wd11. As shown in FIG. 10, first word Wd0 to sixth word Wd5 are related to the first area 1001. Similarly, seventh word Wd6 to twelfth word 11 are related to the second area 1002.

The content of the first area 1001 is described below by referring to drawings. VCOMH7 to VCOMH0 are registers for setting the voltage value at the amplitude high potential side of a liquid-crystal facing electrode signal. VICOML7 to VCOML0 are registers for setting the voltage value at the amplitude low potential side of the liquid-crystal facing electrode signal. T7 to T0 are setting registers for fine adjustment of an LCD driving voltage. GM27 to GM20 are registers for respectively setting a γ curve. GM17 to GM10 are also registers for respectively setting a γ curve. VPTY7 to VPTY0 are parity operation results in the vertical-bit direction. HPTY is a result of performing the parity operation of bit 7 to bit 0 in the same word.

As shown in FIG. 10, the content of the "first area 1001" corresponds to high-order word to low-order word in the "second area 1002" and the same value is held. Specifically, the first word Wd0 corresponds to the seventh word Wd6 and they hold the same value. Similarly, the second word Wd1 corresponds to the eighth word Wd7, the third word Wd2 corresponds to the ninth word Wd8, . . . , and the sixth word Wd5 corresponds to the twelfth word Wd11.

Figure 5:
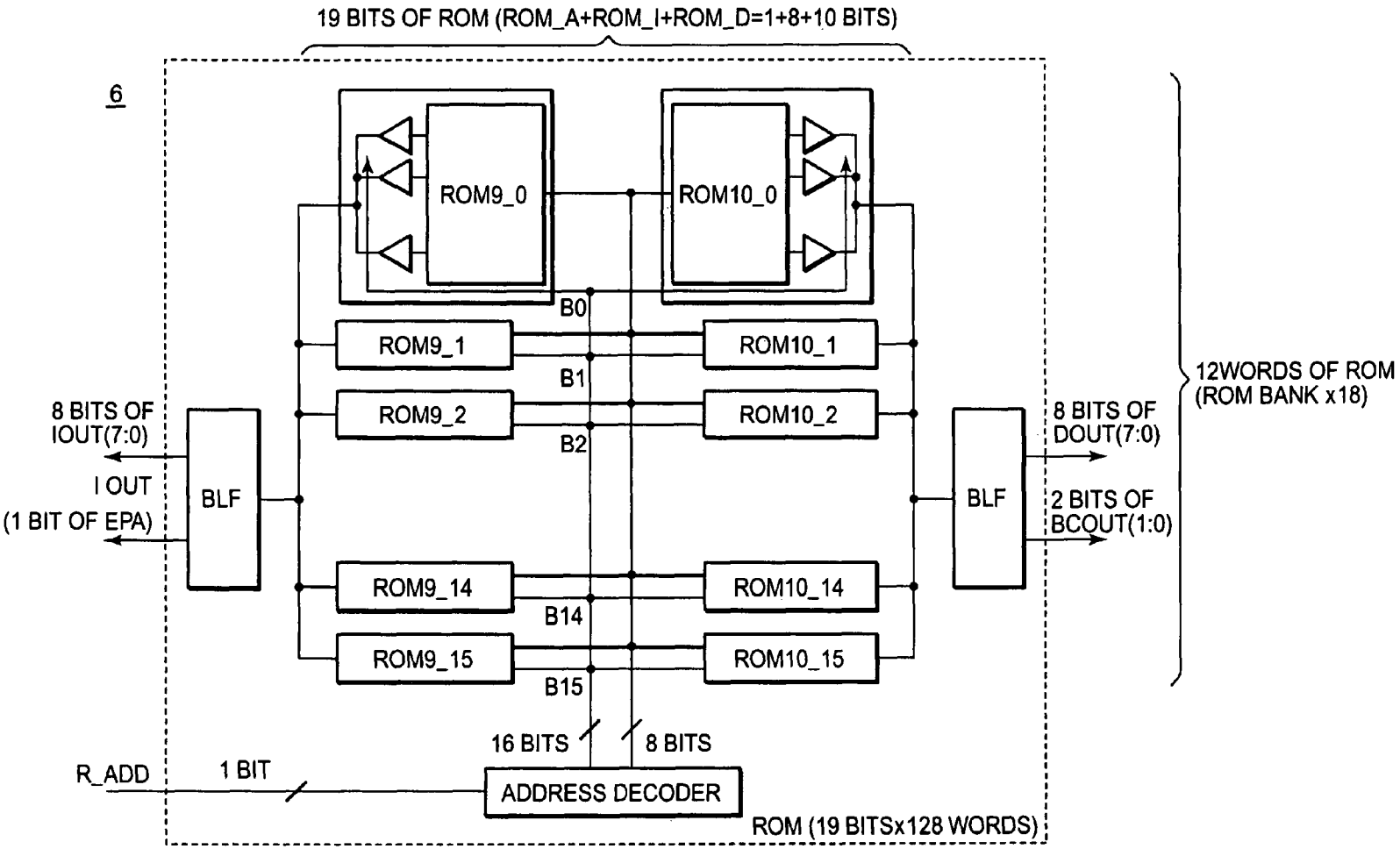
FIG. 5 is a block diagram showing a configuration of a ROM 6.

FIG. 5 is a block diagram showing a configuration of the ROM 6. As shown in FIG. 5, the ROM 6 is constituted by including a ROM area for storing ROM data and a data control section for performing control when reading the ROM data. One-word 19-bit data is stored in the ROM 6. The one-word 19-bit data is constituted of one bit of ROM/EEPROM identification selecting data (IOUT8=EPA bit), eight bits of address data (IOUT[7:0]=ROM_1), eight bits of storage data (DOUT[7:0]=ROM_D), and two bits of byte counter (BCOUT[1:0]) when one register address has a plurality of byte data values. First nine bits of the one-word 19-bit data is stored in a ROM9_n (n is an integer of 0 to 15) block and remaining 10 bits are a ROM10_n (n is an integer of 0 to 15) block. Data for 8 words is stored in one block.

Operations of Embodiment

Figure 6:
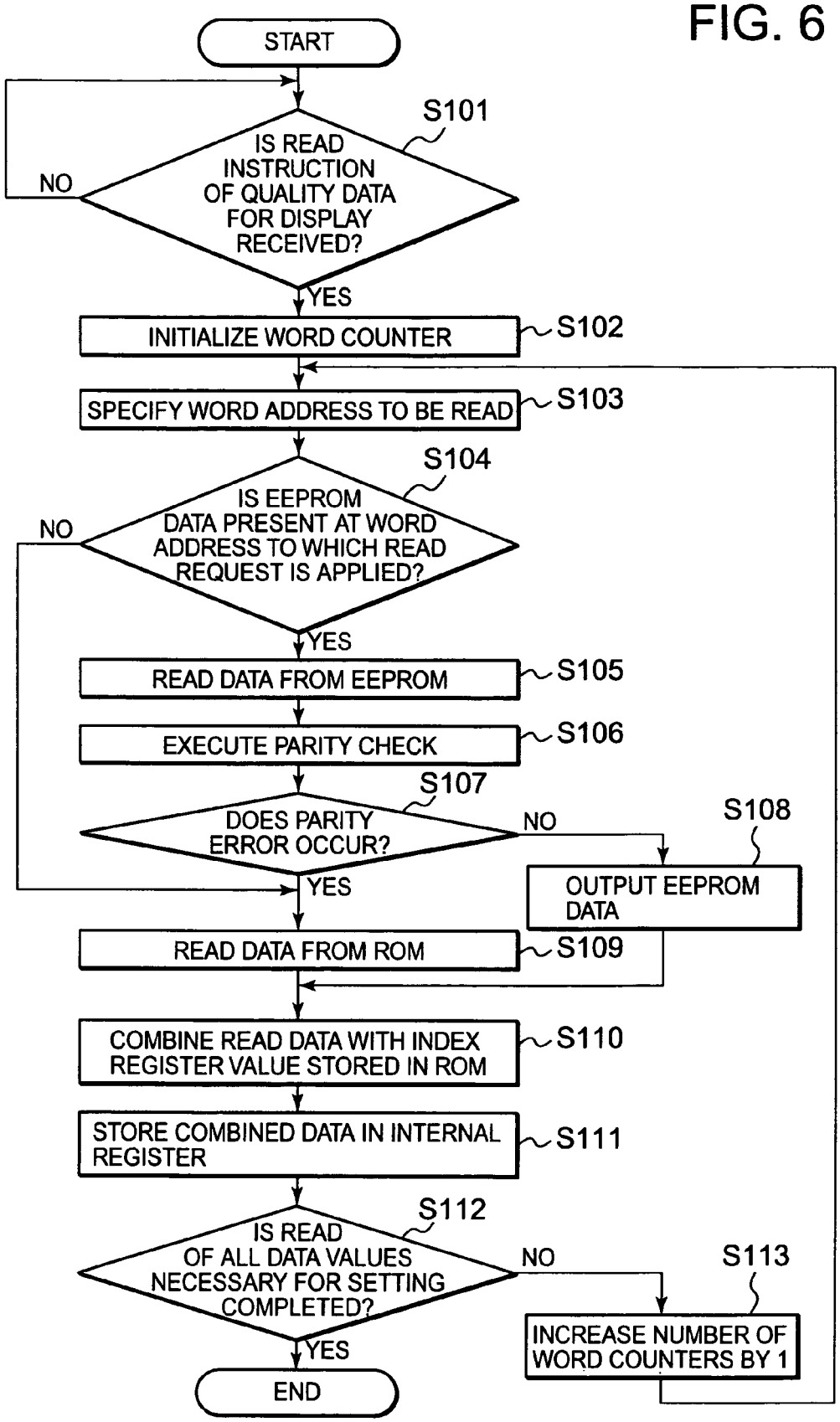
FIG. 6 is a flowchart showing the read operation of the display quality data of this embodiment.

Operations of this embodiment are described below by referring to the accompanying drawings. FIG. 6 is a flowchart showing the read operation of display quality data in this embodiment. In step S101, the LCD control driver 4 monitors whether to receive a read instruction of display quality data. In the monitoring operation, when the LCD control driver 4 does not receive the read instruction of display quality data, the monitoring is continued (flow of NO in step S101). When the LCD control driver 4 receives the read instruction of display quality data, processing advances to step S102. In step S102, the counter 42 of the LCD control driver 4 initializes a word counter. In this case, the counter 42 initializes the word line counter of the EEPROM 5 and that of the ROM 6. Thereby, the comparator (ROM_SEL) 8 is set so that data is read from the first word addresses of the EEPROM 5 and ROM 6. In this case, when specifying a read line, the counter 42 sets a desired word address in this case (step S103).

In step S104, it is determined whether a word address to which a read request is applied in accordance with a determination flag bit stored in the first area 61 is an address present in the EEPROM 5. The determination is performed by determining whether the determination flag bit stored in the first area 61 (ROM_A) is "1" or "0". When the determination flag bit is "0" (when a flag is not set), the EEPROM data corresponding to the word address is not present. Therefore, processing advances to step S109 and data is read from the ROM 6 (NO in step S104). When the determination flag bit is "1" (when flag is set), the data corresponding to a designated word address is read from the EEPROM 5 (step S105).

In step S106, the data read from the EEPROM 5 is supplied to the parity determining section 7. The parity determining section 7 executes the parity check of the data read from the EEPROM 5. The parity determining section 7 extracts the data corresponding to low-order 8 bits of the data read from the EEPROM 5. Thereafter, the parity determining section 7 executes the processing as claimed in a predetermined operation rule for the data of low-order 8 bits to generate the data for parity check. The parity determining section 7 compares the data for parity check with high-order one bit of the data read from the EEPROM 5. As a result of performing the comparison, when it is determined that a parity error does not occur, the parity determining section 7 generates a parity determination signal P_ERR (P_ERR=0) showing no error and transmits data to the comparator (ROM_SEL) 8 together with the signal. As a result of performing the comparison, when it is determined that a parity error occurs, the parity determining section 7 generates a parity determination signal P_ERR (P_ERR=1) and transmits the data to the comparator (ROM_SEL) 8 together with the signal.

There is vertical parity for computing the same corresponding bits of another word in the vertical direction in addition to horizontal parity for performing an operation in one word as a parity check method as described above.

Figures 11, 12:
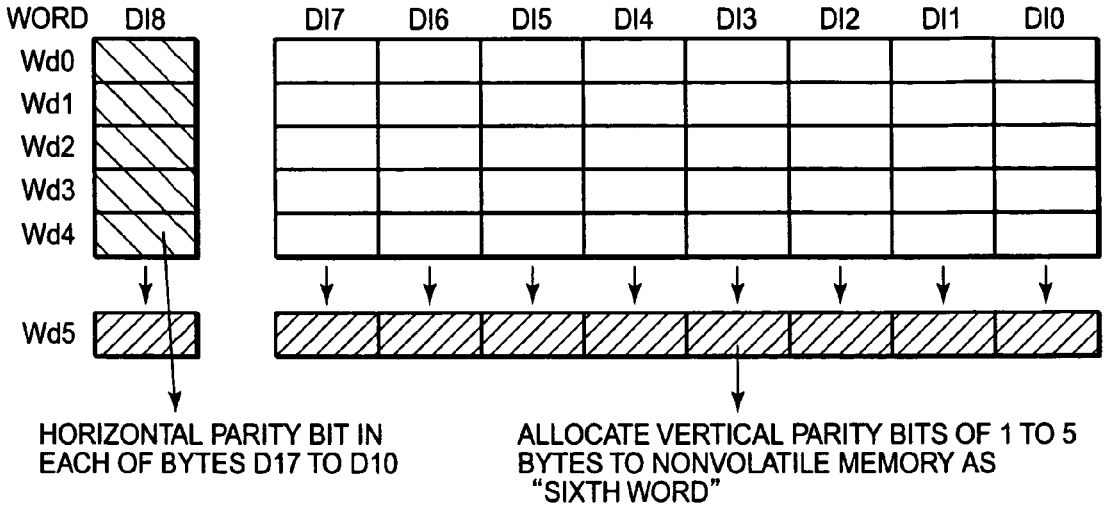
FIG. 11 is an illustration of horizontal parity and vertical parity of this embodiment.
FIG. 12 is an error determination table at the time of the parity check of EEPROM data of this embodiment.

FIG. 11 is an illustration showing operations when executing horizontal parity operation and vertical parity operation. In FIG. 11, DI7 to DI0 in each of five word data values of the first word Wd0 to sixth word Wd4 in the word space 1003 are parity-operated and the operation results are written in and read from DI8 as horizontal parity bits. In the case of the vertical parity operation, one bit in which each word is present (for example, DI3 in FIG. 11) is operated for five words and the operation results are written in or read from a corresponding one bit of the sixth word as vertical parity bits.

Moreover, as the first area 1001 and second area 1002 in FIG. 19 in the case of error determination for an object which performs horizontal parity operation and vertical parity operation to the data having the duplicated same contents, write and read can be made in principle for coincidence of all parity bits and coincidence of data for the first area 1001 and second area 1002. FIG. 12 is an error determination table used for the parity check of the first area 1001 and second area 1002. In FIG. 12, the error determination table is constituted by including a first-area-corresponding check area 1201 and second-area-corresponding check area 1202.

The first-area-corresponding check area 1201 is constituted by corresponding to results of data check and parity check of the first area 1001. Similarly, the second-area-corresponding check area 1202 is constituted by corresponding to results of data check and parity check of the second area 1002. As shown in FIG. 12, when data values of the second area 1002 are compared each other and the data values coincidence with each other as a result of the comparison and all parity results coincide with each other, this is regarded as normal determination (Good (1203)) and others are regarded as error determination (Bad (1204)).

In step S107, the comparator (ROM_SEL) 8 divides the processing to be subsequently executed in accordance with the result of parity check (value of parity determination signal). When the parity determination signal P_ERR (P_ERR=0) showing no error is included in the data transmitted to the comparator (ROM_SEL) 8, processing advances to step S108. When the parity determination signal P_ERR (P_ERR=1) showing occurrence of an error is included in the transmitted data in step S107, processing advances to step S109. In step S108, the comparator (ROM_SEL) 8 outputs the data read from the EEPROM 5.

In step S109, the comparator (ROM_SEL) 8 relates an EEPROM-5 error signal with an error word address by responding to reception of the parity determination signal P_ERR (P_ERR=1) showing occurrence of an error and transmits the signal and address to the processing section 9. In this case, the comparator (ROM_SEL) 8 reads ROM data by assuming that EEPROM data cannot subsequently be credited.

In step S110, the processing section 9 generates 16-bit data (data in which high-order 8 bits are index register values and low-order 8 bits are data register values) by combining the index register values stored in the second area 62 (ROM_I) with the data read from the EEPROM 5 or ROM 6. The processing section 9 writes 16-bit data in its internal LOGIC register 43 (step S111). In this case, when writing the 16-bit data in a register having a plurality of byte data values, the processing section 9 writes these values in the register because the value of a 2-bit byte counter bit (BCOUT) serves as a counter.

In step S112, it is determined whether read of all data values necessary to set the display quality of the LCD panel 2 is completed. As a result of the determination, when read of all data values is not completed and it is necessary to read the data of the next ward address, processing advances to step S113. In step S113, the counter 42 increases the counter number of the word counter by 1 and then, step S103 is restarted. When all data values are read as a result of the determination in step S112, the processing for deciding the display quality of the LCD panel 2 is executed.

As described above, by storing the information on the display quality of the LCD panel 2 in the EEPROM 5 and the initial value of the LCD panel 2 (generally-usable set value of display panel) in the ROM 6, it is possible to drive the LCD panel 2 at an initial-state display quality even if it is impossible to normally read data from the EEPROM 5. Moreover, when the EEPROM 5 is not provided with an address to which a read request is applied, it is possible to drive the LCD panel 2 at a proper display quality by performing an operation so as to read data from the ROM 6 and only mounting the EEPROM 5 having a minimum capacity.

Figures 7, 8A:
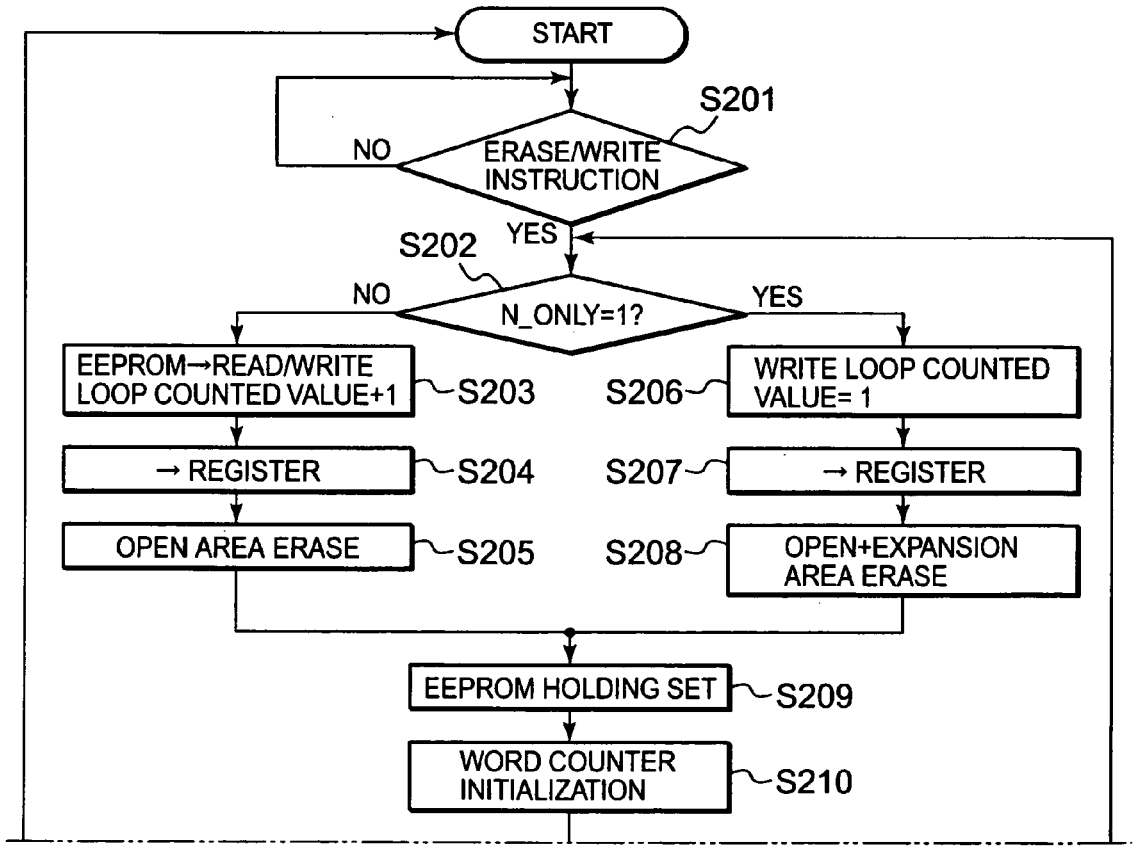
FIG. 7 is a table used for determination of the data read priority between an EEPROM and a ROM.
FIG. 8A is a flowchart showing the first half of the display quality data write operation of this embodiment.

FIG. 7 is a table used to determine which the comparator (ROM_SEL) 8 preferentially outputs the data read from the EEPROM 5 or the data read from the ROM 6. It is preferable that the table shown in FIG. 7 is set to the comparator (ROM_SEL) 8. Z_EPROM, Z_ROM, and COMP shown in FIG. 7 are test signals. Priority is higher in order of Z_EPROM, Z-ROM, COMP, EPA bit, and P_ERR. Z_EPROM is a signal for forcibly designating the EEPROM 5 at the time of a test and Z-ROM is a signal for forcibly designating the ROM 6 at the time of a test, and COMP is a signal for designating the EEPROM 5 or ROM 6 in accordance with a predetermined condition at the time of a test. A blank box portion denotes "don't care". That is, when Z_EPROM is equal to 1, the EEPROM 5 is forcibly accessed independently of the status of other signal. Moreover, when Z_EPROM is equal to 0 and Z_ROM is equal to 1, the ROM 6 is forcibly accessed. In other words, when Z_EPROM is equal to 1, data is always read from the EEPROM 5 and when Z_EPROM is equal to 0 and Z_ROM is equal to 1, data is always read from the ROM 6.

The comparator (ROM_SEL) 8 determines whether the data stored in the EEPROM 5 and ROM 6 is proper in accordance with a determination signal (e.g. parity determination signal) transmitted from each functional block and selectively outputs the data read from the EEPROM 5 and ROM 6. A selected-block display area 81 shows from which storage area of the EEPROM 5 or ROM 6 to read data correspondingly to a determination signal supplied to the comparator (ROM_SEL) 8. Determination signal display areas (82 to 86) are table areas corresponding to determination signals received by the comparator (ROM_SEL) 8.

As described above, the comparator (ROM_SEL) 8 reads only EEPROM data when Z_EPROM is equal to 1. In the case of Z_ROM=1, the comparator 8 reads only ROM_D 8-bit data from the third area 63 (ROM_D). In this case, the comparator 8 reads ROM_D even in the case of the same word line as the EEPROM 5. Moreover, the comparator reads data from the EEPROM 5 at COMP=1 and reads data from the second area 62 (ROM_I) at P_ERR=1. Furthermore, the comparator reads data from the EEPROM 5 at EPA bit=1 and P_ERR=0.

The number of word line addresses of the ROM 6 is larger than the number of word line addresses of the EEPROM 5. Therefore, even if a designation for reading data from the EEPROM 5 is output, when a word address not corresponding to the EEPROM 5 (no stored data) is selected, comparator (ROM_DEL) 8 selects and reads the data from the ROM 6. A comparison selection result output from the comparator (ROM_SEL) 8 is combined with an index register value output from the ROM 6 and 16-bit data (data in which high-order 8 bits are an index register value and low-order 8 bits are a data register value) is generated. The SEL 45 writes the 16-bit data in the internal register 43. When the SEL 45 writes a plurality of byte data values in the internal register 43, the value of 2 bits of BCOUT serves as a counter. The processing section 9 detects the value and properly stores it in the register. In this case, it is assumed that signals of above-described Z_EPROM, Z_ROM, COMP, and P_ERR are generated by the processing section 9 (internal LOGIC).

Figure 8B:
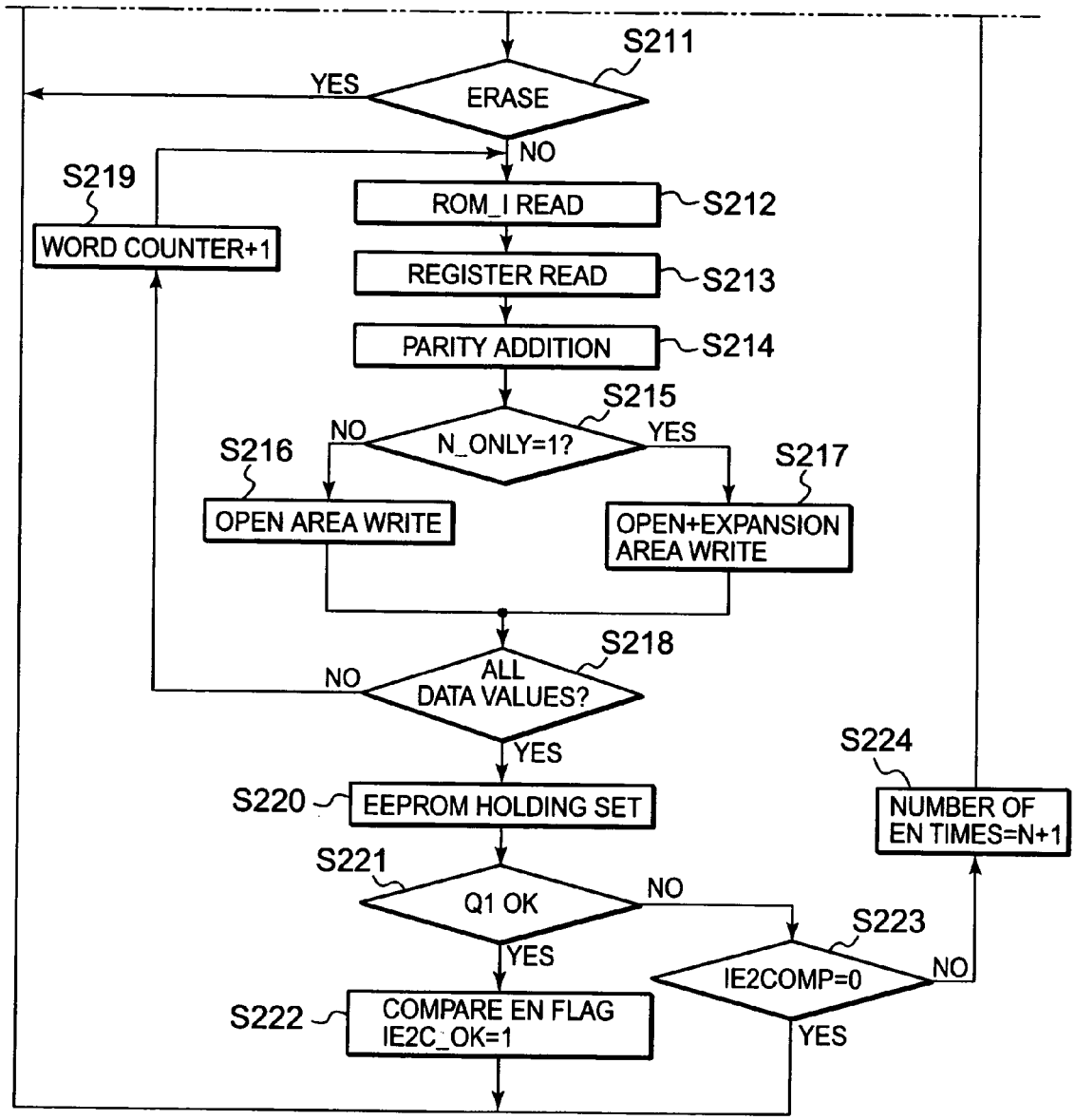
FIG. 8B is a flowchart showing the second half of the display quality write operation of this embodiment.

FIGS. 8A and 8B are flowcharts showing the write/erase operation of the EEPROM 5 on this embodiment. The EEPROM 5 checks the value of N_ONLY when an erase/write instruction is output. Access to the normal area is realized at N_ONLY=0 and access to an expansion area is realized at N_ONLY=1 (step S201 to step S202). The expansion area is used to store a test register value and the number of write times of the EEPROM 5. The LCD control driver 2 can detect the abrasion degree of an EEPROM block by storing the number of write times of the EEPROM 5.

The processing section 9 reads the number of write times from the EEPROM 5 at N_ONLY=0 and stores the number of write times in the internal LOGIC register 43 by adding 1 to the present write loop counted value. Then, the processing section 9 deletes the EEPROM data in an open area (access area) (steps S203 to step S205).

The processing section 9 sets a write loop count to 1 at N_ONLY=1. Therefore, when N_ONLY is equal to 1, access to an expansion area is realized. Because the expansion area normally serves as an area for storing the number of write times in the EEPROM 5, the processing section 9 stores the number of write times in the expansion area of the internal LOGIC register 43 without counting up the number of write times in the normal area at N_ONLY=1. Thereafter, the processing section 9 deletes the EEPROM data in the open+expansion area (all areas) (step S206 to step S208).

Then, the processing section 9 sets the EEPROM 5 to a holding state and designates a word address to be written (ROM_I). The processing section 9 reads the data to be written from an internal register, adds the parity as a result of parity-operating the data to be written, selects whether to use a normal area or expansion area in accordance with the value of N_ONLY, and then writes data in the EEPROM (step S209 to step S217).

After completing write of the present word address, it is determined whether write of all word addresses of the EEPROM is completed (step S218). When write of all word addresses is not completed, the value of the word counter is increased by 1 and processing returns to the write flow again (step S219). After completing write of all data values, processing changes to EEPROM holding setting (step S220). After completing holding setting, the written EEPROM value is compared with an internal register value (=operation of QI) (step S221). As a result of the comparison, when the written EEPROM value coincides with the internal register value, a normal-signal write completion signal IE2C_OK is set to 1

(flow of YES in step S221). After completing normal write, processing returns to a reception standby state of the erase/write instruction. As a result of comparing the data read from the EEPROM 5 with the internal LOGIC register 43 (=operation of QI), when the data does not coincide with the register 43, IE2COMP becomes equal to 1 and processing returns to write flow again to rewrite the EEPROM (step S223 to step S224).

The index of the data to be stored in the EEPROM or write/read sequence is decided in accordance with the value of the ROM. To change the index or sequence, it is possible to correspond to that by switching the eye of the ROM to an AL wiring. Similarly, in the case of ROM data, by changing ROM_D, it is possible to change the initial value of the register to AL wiring. As described above, when storing the information corresponding to the information held by the ROM 6 in the EEPROM 5, it is possible to drive the LCD panel 2 when an error occurs in the data of the EEPROM 5 by specifying and writing the word address of the EEPROM 5 and thereby properly using the data in the ROM 6.

Figure 9:
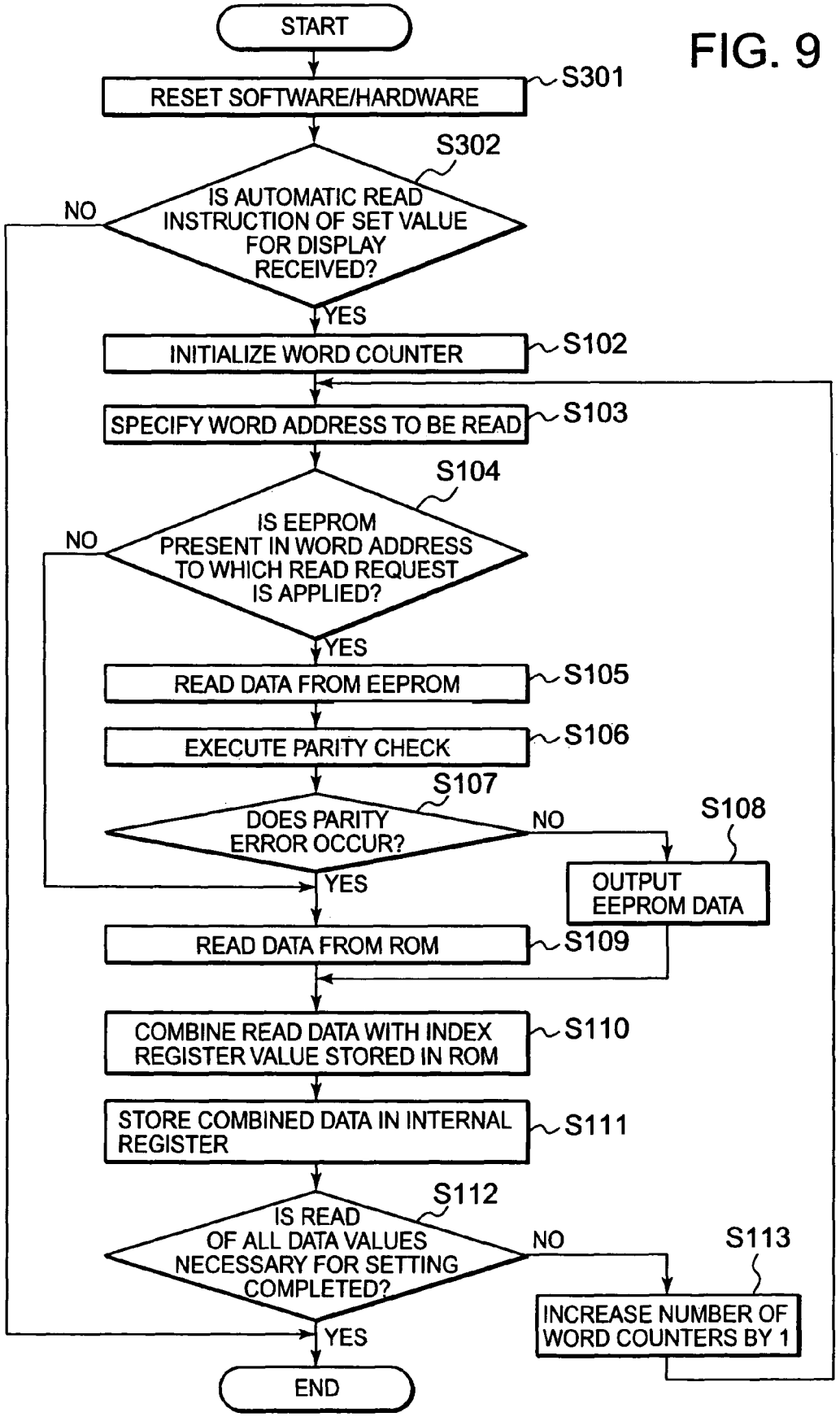
FIG. 9 is a flowchart showing another read operation of this embodiment.

FIG. 9 is a flowchart showing another read operation of this embodiment. The flowchart shown in FIG. 9 shows the operation for automatically reading the display-quality setting data of the LCD panel 2. A liquid-crystal display having the LCD driving circuit 1 of this embodiment has a hardware (or software) switch for resetting. In FIG. 9, by operating the hardware (or software) switch for resetting in step S301, resetting for display quality is executed. In step S302, it is determined whether to receive the automatic read instruction by responding to the resetting operation. As a result of the determination, when the automatic read instruction is received, automatic read for display quality data is executed ("YES" in step S302).

Thus, by automatically reading the data for display quality by responding to the resetting operation, it is possible to drive an LCD panel without using an external command even at the time of resetting. That is, it is possible to read ROM data at the time of resetting and drive the LCD panel at an initial set value. Moreover, by executing the same operation at the time of write, it is possible to automatically execute a specific setting operation for each display system set by an LCD panel maker at the time of shipping inspection and easily keep an optimum display quality.

As described above, the communication between the EEPROM set to the outside of the LCD control driver 4 and the LCD control driver 4 has been performed so far through serial transfer on a wiring board. However, by setting the EEPROM 5 in the LCD control driver 4, it is possible to use parallel I/F transfer in a chip for the communication between the EEPROM 5 and the LCD control driver 4. Moreover, by setting the ROM 6 in the LCD control driver 4 and storing the data to be written in the EEPROM 5 in the ROM 6, it is possible to initialize a register without using an external command. Furthermore, it is possible to use the data as the backup data for the time of malfunction of the EEPROM. Therefore, also when the EEPROM 5 malfunctions, it is possible to perform error check in the LCD control driver without through a CPU, detect an error, and change to initial quality setting. Therefore, even if there is not resetting from the CPU, it is possible to keep a standard display quality though the display quality setting specific to an LCD panel (contrast adjustment and driving voltage setting) cannot be made and it is possible to avoid the worst situation that "display cannot be made". Thereby, the load to the CPU is decreased.

Moreover, an error word and error signal of the EEPROM 5 are output by performing parity check. Thereby, it is possible to communicate a trouble or malfunction of the EEPROM 5 to the outside of the LCD display unit. Thereby, it is possible to keep the reliability of the EEPROM and at the same time, simplify a shipping test. Therefore, the present invention makes it possible to easily initialize an LCD panel by setting a ROM and an EEPROM in a display-system LSI driving a liquid-crystal panel.

Furthermore, by setting the EEPROM 5 in the LCD control driver 4, it is possible to decrease the number of components of and the area occupied by the LCD display unit. In this case, though the EEPROM set to the outside of the LCD control driver 4 is eliminated, it is possible to keep the function of the EEPROM. Furthermore, the ROM 6 is used for an initial set value whose rewriting is unnecessary. When storing the same information content, it is possible to prevent the chip area of the LCD control driver 4 from increasing by using the ROM 6 because the chip area of the ROM 6 is smaller than that of the EPROM. Thereby, because it is possible to decrease the cost of an LCD module, this is very effective for downsizing and lower price of a display unit requested from markets.

As shown in FIG. 10, duplicate Data stored in EEPROM by different address is used to enhance its reliability of the data. That is, when those data are compared and judged as the same data and the parity of each data is good, the data is judged as the accurate data. The accurate data is used as a display quality specifying information which is read out from EEPROM to drive the specified display panel.

The duplicate data is able to use in writing check mode and reading out check mode. Table 1 shows the writing check mode. In order to check the reliability of EEPROM, in the write mode, an user can check the states as shown in table 1. In writing check mode, write data and read data are compared and the parity data produced based on the write data and the parity data read with read data are compared. It is noted that a test circuit for the write test mode is not shown in Figures. Criteria (1) means that data in the Aria 1 and 2 are judged as normally written. Criteria (2) means that either data in the Aria 1 or data in the Aria 2 are judged as normally written. Criteria (3) means that data in the Aria 1 and 2 are judged as badly written.

TABLE 1 check mode in writing

| First Area | | Second Area | | |
|---|---|---|---|---|
| Data Check | Parity Check | Data check | Parity check | criteria |
| Good | Good | Good | Good | 1 |
| Good | Good | Good | Bad | 2 |
| Good | Good | Bad | Good | 2 |
| Good | Good | Bad | Bad | 2 |
| Good | Bad | Good | Good | 2 |
| Good | Bad | Good | Bad | 3 |
| Good | Bad | Bad | Good | 3 |
| Good | Bad | Bad | Bad | 3 |
| Bad | Good | Good | Good | 2 |
| Bad | Good | Good | Bad | 3 |
| Bad | Good | Bad | Good | 3 |
| Bad | Good | Bad | Bad | 3 |
| Bad | Bad | Good | Good | 2 |
| Bad | Bad | Good | Bad | 3 |
| Bad | Bad | Bad | Good | 3 |
| Bad | Bad | Bad | Bad | 3 |

Table 2 shows the read out check mode. We can set 4 criteria as shown in Table 2. The criteria 1 means that all status are good. The criteria 2 means that the parity checks of 1st and 2nd aria are good. The criteria 3 means that one of the parity check of 1st and 2nd aria and data compare are good. The criteria 4 means that one of the parity check of 1st and 2nd area is only good. For example, we can use the criteria 1 as default. Moreover, we can selectively use the aria 1 or 2 based on the criteria. We may use mandatory one of Aria 1 and 2. We can use the criteria 1 to define each data of EEPROM as non-defective data. We may use the combination of the criteria 1 and 3 to define each data of EEPROM as non-defective data. We may further use the combination of the criteria 1, 3 and 4 to define each data of EEPROM as non-defective data.

TABLE 2

| check mode in reading out | | | |
|---|---|---|---|
| 1st Area Parity Check | 2nd Area Parity Check | Area1–2 Data compare | criteria |
| Good | Good | Good | 1 |
| Good | Good | Bad | 2 |
| Good | Bad | Good | 3 |
| Good | Bad | Bad | 4 |
| Bad | Good | Good | 3 |
| Bad | Good | Bad | 4 |
| Bad | Bad | Good | 3 |
| Bad | Bad | Bad | 2 |

Data comparison of the aria 1 and 2 is performed in the ROM_SEL 8 of FIG. 3. A data comparison circuit is provided in the ROM_SEL 8 while not shown in FIG. 3. Moreover, the ROM_SEL 8 has a criteria decision circuit to output the criteria 1-4 of the table 2 based on the parities of the 1st and 2nd aria and the comparison results. The ROM_SEL 8 includes a selector which selectively outputs the output of ROM 6 or the output of EEPROM 5 in response to the output of the criteria decision circuit.

The present invention is not limited only to the above embodiments and examples, but may include many variations and modifications as long as those variations and modifications are included within the scope of this invention which is defined by the appended Claims.

What is claimed is:

1. A display unit, comprising:

a display panel; and a driver for displaying an image on said display panel, including, a first memory storing display quality specifying information specifying a display quality of said display panel;

a second memory storing display quality initial information corresponding to specification of the display quality of said display panel; and a processing section which reads the display quality specifying information from the first memory, executes a check of the read display quality specifying information, and if the check indicates an error in the read display quality specifying information, then the processing section reads the display quality initial information corresponding to the read display quality specifying information from the second memory.

2. The display unit as claimed in claim 1, wherein said processing section further comprises:

a selector outputting one of the display quality specifying information and the display quality initial information in response to a condition of said display quality specifying information; and an image generating circuit generating image data in accordance with information output from the selector.

3. The display unit as claimed in claim 1, wherein the first memory comprises a rewritable nonvolatile memory and stores setting values which are individually set correspondingly to the display panel as the display quality specifying information.

4. The display unit as claimed in claim 3, wherein said check comprises a parity check, and wherein said processing section further comprises:

a parity determining section executing the parity check of the display quality specifying information read from, the rewritable nonvolatile memory to output a parity check result to the selector, wherein the selector, when an error occurs in the read display quality specifying information, outputs display quality initial information corresponding to the display quality specifying information which is judged as the error.

5. The display unit as claimed in claim 4, wherein the rewritable nonvolatile memory duplicates one of all and a part of the display quality specifying information on another address of the rewritable nonvolatile memory.

6. The display unit as claimed in claim 5, wherein said processing section reads the information on the display quality of the display panel from first and second memories by responding to a setting mode of the display quality of the display panel.

7. The display unit as claimed in claim 6, wherein said driver further comprises a storing section for storing display quality data, wherein the processing section designates a read of the information on the display quality from the first memory and the second memory by responding to an automatic read instruction generated by responding to an initializing of the display quality data stored in the storing section, and wherein the first memory and the second memory output the information on the display quality to an output section by responding to the designation.

8. The display unit of claim 1, wherein said display quality specifying information and said display quality initial information comprise control register values.

9. The display unit of claim 1, wherein said processing section further comprises a parity determining section which is connected to said first memory and determines whether an error occurs in data read from said first memory.

10. The display unit of claim 1, wherein said processing section further comprises a comparator which compares data read from said first memory with data read from said second memory, and outputs data in accordance with a result of said comparison.

11. The display unit of claim 1, wherein said display quality initial information comprises general purpose setting information corresponding to specification of the display quality of the display panel.

12. The display unit of claim 1, wherein said check comprises a parity check, and wherein said processing section further comprises:

a parity determining section which reads the display quality specifying information from the first memory, executes the parity check and outputs a parity check result; and a selector which receives the parity check result and if the parity check result indicates a parity error in the read display quality specifying information, then the selector reads the display quality initial information corresponding to the read display quality specifying information from the second memory and outputs the read display quality initial information.

13. A driver for driving a display panel, comprising a first memory formed on a chip and storing display quality specifying information for specifying a display quality of the display panel;

a second memory formed on the chip and storing display quality initial information usable for specification of the display quality corresponding to said display panel; and a processing section which reads the display quality specifying information from the first memory, executes a check of the read display quality specifying information, and if the check indicates an error in the read display quality specifying information, then the processing section reads the display quality initial information corresponding to the read display quality specifying information from the second memory.

14. The driver as claimed in claim 13, wherein the processing section further comprises:

a selector outputting one of the display quality specifying information and the display quality initial information in response to a condition of said display quality specifying information; and an image generating circuit generating image data in accordance with the information output from the selector.

15. The driver as claimed in claim 14, wherein the first memory comprises a rewritable nonvolatile memory and stores setting values which are individually set correspondingly to the display panel as the display quality specifying information.

16. The driver as claimed in claim 15, wherein the processing section further comprises:

a parity determining section executing a parity check of the display quality specifying information read from the rewritable nonvolatile memory to output a parity check result to the selector, wherein the selector, when an error occurs in the read display quality specifying information, outputs display quality initial information corresponding to the display quality specifying information which is judged as the error.

17. The driver as claimed in claim 16, wherein the rewritable nonvolatile memory duplicates all or a part of the display quality specifying information on another address of the rewritable nonvolatile memory and holds the same content.

18. The driver as claimed in claim 17, wherein the first memory outputs the display quality specifying information to the parity determining section by responding to a setting start instruction supplied from a CPU, wherein the parity determining section executes the parity check of the display quality specifying information output from the rewritable nonvolatile memory and outputs an obtained parity check result to the selector, and wherein the second memory outputs the display quality initial information to the selector by responding to the setting start instruction.

19. A driving method of a display unit having a display panel and a driving circuit, comprising:

reading display quality specifying information for specifying a display quality of the display panel which is connected to the driving circuit, from a first memory;

executing a check of the read display quality specifying information; and if the check indicates an error in the read display quality specifying information, then reading display quality initial information usable to specify the display quality of said display panel, from a second memory.

20. The display unit driving method as claimed in claim 19, wherein the first memory stores setting values which are individually set correspondingly to the display panel as the display quality specifying information, and wherein the driving circuit drives the display panel by preferentially using the information stored in the first memory.

21. The display unit driving method as claimed in claim 20, wherein said executing said check comprises executing a parity check of the display quality specifying information output from the first memory, and wherein said reading the initial information comprises reading the initial information when an error occurs in the display quality specifying information as a result of the parity check.

22. The display unit driving method as claimed in claim 21, wherein the first memory duplicates all or a part of the display quality specifying information on another address of the first memory.

23. The display unit driving method as claimed in claim 22, wherein the first memory comprises a storing capacity corresponding to a capacity of the display quality specifying information.

24. The display unit driving method as claimed in claim 23, further comprising:

designating a reading the information on display quality from the first memory and the second memory by responding to a start of setting display quality of the display panel; and outputting the information on display quality from the first and second memories respectively to an output unit by responding to each designation.

25. The display unit driving method as claimed in claim 24, further comprising:

receiving an automatic read instruction generated by responding to an initializing of a set display quality value;

designating a read of the information on display quality from the first memory and the second memory by responding to the automatic read instruction.

* * * * *